US011484771B2

(12) United States Patent
Oyefeso

(10) Patent No.: US 11,484,771 B2
(45) Date of Patent: Nov. 1, 2022

(54) INSERTABLE SKATE OUTSOLE SHIM FOR INCREASED ATTACK ANGLE

(71) Applicant: eNJineering Enterprise, Inc., Freehold, NJ (US)

(72) Inventor: Adedotun Oyefeso, Freehold, NJ (US)

( * ) Notice: Subject to any disclaimer, the term of this patent is extended or adjusted under 35 U.S.C. 154(b) by 0 days.

(21) Appl. No.: 17/181,469

(22) Filed: Feb. 22, 2021

(65) Prior Publication Data

US 2022/0266118 A1 Aug. 25, 2022

(51) Int. Cl.
*A63C 1/16* (2006.01)
*A63C 1/22* (2006.01)
*A63C 1/40* (2006.01)

(52) U.S. Cl.
CPC . *A63C 1/22* (2013.01); *A63C 1/40* (2013.01)

(58) Field of Classification Search
CPC ..... A63C 1/22; A63C 1/40
See application file for complete search history.

(56) References Cited

U.S. PATENT DOCUMENTS 4,008,901 A 2/1977 Conn
4,132,424 A 1/1979 Olivieri
4,139,209 A 2/1979 Humphreys
5,184,834 A 2/1993 Yu
5,484,148 A 1/1996 Olivieri
5,732,481 A * 3/1998 Farhad ..... A43B 7/1464 36/44
6,109,622 A 8/2000 Reynolds
6,164,667 A 12/2000 Olivieri
6,467,778 B1 10/2002 Goldsmith et al.
6,851,682 B2 2/2005 Durocher
7,387,302 B2 6/2008 Goldsmith et al.
7,806,418 B2 10/2010 Labonte et al.
7,905,501 B2 3/2011 Landry
9,295,901 B2 3/2016 Cruikshank et al.
2010/0263231 A1* 10/2010 Smirman ..... A43B 7/142 36/43
2011/0316243 A1* 12/2011 Glass ..... A63C 17/068 280/11.3
2013/0001902 A1* 1/2013 Rotiroti ..... A63C 1/22 280/11.31
2013/0062840 A1* 3/2013 Kelly ..... A63C 1/22 280/11.115
2016/0038788 A1* 2/2016 McMillan ..... A63C 1/22 73/488

FOREIGN PATENT DOCUMENTS

EP 1222946 B1 7/2006
EP 2471398 A1 7/2012

* cited by examiner

*Primary Examiner* — Brian L Swenson
(74) *Attorney, Agent, or Firm* — Williams Intellectual Property; Benjamin F. Williams

(57) ABSTRACT

An insertable skate outsole shim for increased attack angle is installable between the outsole heel of a skate and the rear post of a blade or wheel holder. The outsole shim raises the heel of the skater and postures the skater with weight forward decreasing dorsiflexion of the ankle and accommodating deeper knee bend. The outsole shim dampens vibrations and absorbs forces applied during skating. The outsole shim is producible at different sizes adapted for different skating performance. The outsole shim may be produced with an angled surface to correct for overpronation or oversupination.

12 Claims, 5 Drawing Sheets

INSERTABLE SKATE OUTSOLE SHIM FOR INCREASED ATTACK ANGLE

BACKGROUND OF THE INVENTION

Various types of ice skates are known in the prior art, adapted to the various forms, styles, and sports requiring ice skating. Modernly, skates for ice hockey players typically comprise a blade holder that mounts to the outsole of the skate boot for installation of a securable blade therein. This design enables removing the blade for drying, sharpening, maintenance, or replacement. Further, blades of varying designs may be used in a common holder. Such fungibility of parts is useful for adapting and upgrading components of the skate without having to replace the entire skate.

Modernly, blade holders are composite or polymeric molded materials devised for tensile and compressive strength while minimizing weight. A favored design seen in the hockey arts comprises a rear post, securable under the outsole heel, and a front post, securable under the outsole toe. To reduce unnecessary weight, a gap is maintained between the rear post and the front post underlying the outsole foot plate.

Means employed by hockey players and other inline skaters to alter their performance include use of insoles and inserts placed inside the skate boot, either under the foot (such as a custom footbed) or over the toes (an insert). Such footbeds and inserts are devised to correct for pronation or supination, to reorient the posture of the feet, or to increase tautness of the boot upper around the foot and conform the boot to the skater to alter performance.

What is needed is an insertable skate outsole shim, securable between the rear post of the blade holder and the outsole heel, to increase the skater's angle of attack, absorb forces incurred during aggressive skating, to enhance a skater's performance.

Field of the Invention

The present invention relates to ice skate accoutrements in general and, in particular, to an insertable skate outsole shim for increased attack angle that is devised for easy installation between a rear post of a blade holder and the outsole heel of a skate boot, to enhance skater performance by damping vibrations and increasing the forward angle of attack of the skater.

SUMMARY OF THE INVENTION

The present insertable skate outsole shim for increased attack angle has been devised to enable a convenient means of damping vibration and enabling a more forward, aggressive skate posture when ice skating.

The present invention is devised particularly for ice hockey players, however other in-line skaters may benefit from the general concept informing the device; that is, an exterior insert installable between the heel of the outsole and the blade or truck or wheel holder or such other support as may enable insertion of a shim thereat, that may be applied wherever forward-facing in-line skating is desirably undertaken. Thus, while the general discussion herein is directed to ice hockey skates in particular, the general concept contemplated herein is not intended to be construed as limited for use in the ice hockey arts only. The present insertable skate outsole shim for increased attack angle is further contemplated as a fungible element easily installable to an existing pair of ice skates. The insertable skate outsole shim is securable underneath the heel of the boot outsole, atop the rear post of the skate blade holder (or other supporting structure of in-line footwear, such as a roller blade, say), to effectively raise the heel of the boot off a horizontal axis relative the boot toe. Variously sized and shaped outsole shims are contemplated as within the scope of this disclosure, whereby a single skater may employ a diversity of such outsole shims for different purposes or positions even with the same pair of skates. The outsole shim may include angled surfaces adapted to correct or compensate for a player's pronation or supination. Further, the present insertable skate outsole shim includes compressive properties suitable for damping vibration and absorbing forces induced during skating.

The overall object of the present invention, then, is to provide an installable shim that increases the skater's angle of attack for more aggressive skating, dampens vibration and absorbs some forces otherwise applied directly to the rear post of the blade holder, and presents an interchangeable part that increases the utile life of more expensive parts of the skate proper.

The present insertable skate outsole shim for increased attack angle, therefore, includes a polymeric, generally rigid crown member and a generally elastomeric, polymeric crest member. The crest member is configured to seat into the crown member, as will be described subsequently. Once the crest member is installed to the crown member, the crown member is disposed perimetrically surrounding a central plug disposed upon the crest member. The assembled shim is then securable to the skate in between the rear post and the outsole by action of the exiting fasteners used to secure the rear post of the blade holder to the outsole.

Improved athletic stance, skating stride, and ankle-boot alignment are achieved in use of the outsole shim allowing an increased height and adjustable tilt underneath the skate boot but above the blade holder of the skate. The increased attack angle decreases dorsiflexion of the ankle and allows for a deeper knee bend. The shim can be produced angled to compensate for overpronation or oversupination where desired. Correct alignment of the foot in relation to the boot through a full skating stride produces less stresses on the skate boot and the reduction in dorsiflexion maintains tautness of the boot to the skater's foot without adding additional stress to the laces and the boot upper. The compressibility and rubberlike properties of at least a part of the shim, as will be described subsequently, dampen vibrations and reduce forces applied directly to the outsole from the rear post and prolong the skate's integrity over time.

Discussing first the crown member. In an example embodiment contemplated herein, the crown member is an ellipsoidal polymeric molding disposed circumferentially bounding an open ellipsoidal center. In the example embodiment contemplated herein, the crown member includes a longitudinal axis and a transverse access sized to superimpose atop an existing rear post of a blade holder. The crown member includes a plurality of apertures disposed to superimpose and align atop existing holes in the boot heel wherein a plurality of fasteners engages to secure the rear post of the blade holder thereto. Each of the plurality of fasteners, therefore, secures through the blade holder rear post into the heel of the boot outsole by passing through an associated one of the plurality of apertures of the crown member.

The crest member is devised to seat a central plug tautly engaged in the open ellipsoidal center of the crown member. That is, the crest member seats into the open center of the crown member such that the crown member flushly girds the central plug. The crest member includes a thin, polymeric skirt member that overlies the crown member when the crest member is seated into the crown member, as described above. The fasteners used to secure the blade holder to the boot outsole pierce through this skirt member to tautly maintain the assembled shim between the rear post and the outsole. The central plug is compressible and elastomeric. Compressive forces may thus be distributed into and absorbed by the central plug during skating. The central plug may include a series of molded concentric rings disposed interiorly, to present a series of compressive walls encircling narrow voids that enable distribution and absorption of force and vibration, varying configurations of which may control for compressibility between individual outsole shims.

The outsole shim may be produced with an angled surface to compensate for an individual skater's pronation or supination. The outsole shim is contemplated to be producible to spec or by custom order as well as produced in bulk for particular skate models and sizes. The overall height of the shim may be produced at varied dimensions to increase or decrease the angle of attack allowing a single player to install different outsole shims for different gameplay, as desired. Further, it is contemplated that the crown member may alternatively be rubberlike, and compressible. Some embodiments are contemplated wherein the crown member is installable absent the crest member or wherein the crown member and the crest member are produced as an integrated whole. The present two-piece assembly represents a preferred embodiment due to ease of production via molding or additive-printing, whereby the crown member may be made of a different composition or present a different structural arrangement than the crest member, properties that are complemented when the outsole shim is installed as a single unit. Thus, while the two piece outsole shim discussed hereinbelow represents a preferred embodiment, additional embodiments that are singular, piecemeal, assemblable, integrated, separate, comprised of composite or singular materials, molded, additively-printed, fused, cooled, pressured, or otherwise formed into the requisite shape and producible at different dimensions along each axis to map to particular existing footwear and to produce a range of effects in dampening vibrations and absorbing forces as well as orienting the foot of the skater to correct for pronation, supination, and to present increased angles of attack off the horizontal axis, are contemplated as within scope of the inventive step set forth herein.

Thus has been broadly outlined the more important features of the present insertable skate outsole shim for increased attack angle so that the detailed description thereof that follows may be better understood and in order that the present contribution to the art may be better appreciated.

Objects of the present insertable skate outsole shim for increased attack angle, along with various novel features that characterize the invention are particularly pointed out in the claims forming a part of this disclosure. For better understanding of the insertable skate outsole shim for increased attack angle, its operating advantages and specific objects attained by its uses, refer to the accompanying drawings and description.

BRIEF DESCRIPTION OF THE DRAWINGS

Figures

DETAILED DESCRIPTION OF THE DRAWINGS

With reference now to the drawings, and in particular FIGS. 1 through 6 thereof, example of the instant insertable skate outsole shim for increased attack angle employing the principles and concepts of the present insertable skate outsole shim for increased attack angle and generally designated by the reference number 10 will be described.

Referring to FIGS. 1 through 6 a preferred embodiment of the present insertable skate outsole shim for increased attack angle 10 is illustrated.

Figure 1:
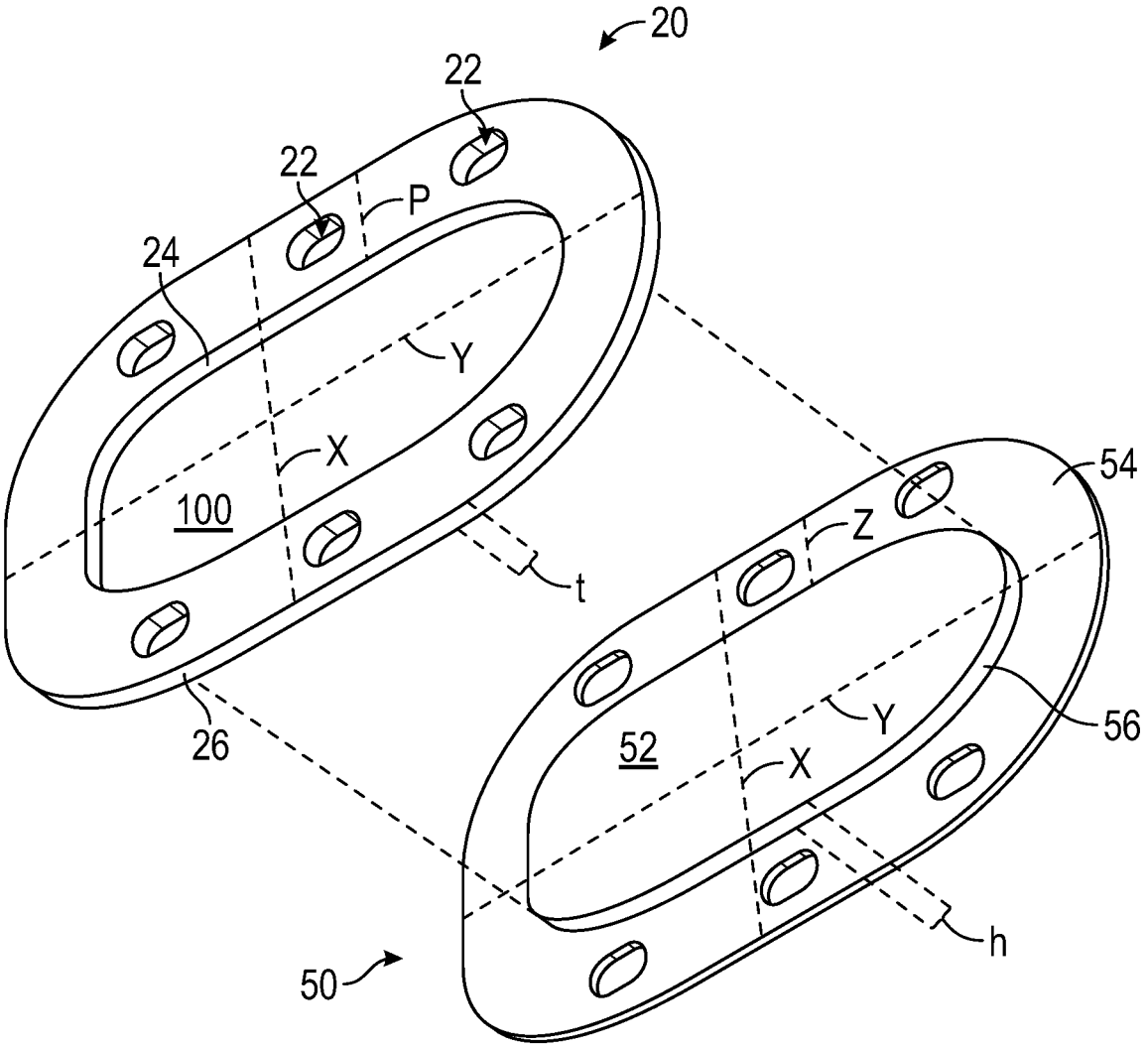
FIG. 1 is an elevation view of an example embodiment of the insertable skate outsole shim for increased attack angle showing a crown member and crest member in exploded view.

FIG. 1 illustrates an example embodiment of the insertable skate outsole shim for increased attack angle 10 in elevation and exploded view. In the example embodiment illustrated, insertable skate outsole shim 10 is generally ellipsoidal having transverse axis x and longitudinal axis y. Outsole shim 10 includes generally rigid crown member 20 and generally elastomeric, rubberlike, or compressible crest member 50.

Crown member 20 is a generally ellipsoidal body comprising a polymeric, generally rigid perimeter surrounding open center 100. Plurality of apertures 22 are disposed along longitudinal sections of crown member 20, positioned to engage with plurality of fasteners 75, as will be discussed herein below. Each of the plurality of apertures 22 is shown in this example embodiment as ellipsoidal, allowing for some play in position upon the blade holder 80 rear post 82 (see, e.g., FIG. 2). Crown member 20 is generally unyielding, stiff, polymeric, and molded or additively printed to specific dimensions devised to superimpose atop an existing rear post 82 of blade holder 80, as will be discussed hereinbelow (see, e.g., FIG. 2).

Crest member 50 includes rubberlike, elastomeric and/or compressible central plug 52 and relatively thin, flexible skirt member 54. Central plug 52 is rubberlike and compressible and may dampen vibrations and absorb forces incurred during use to increase comfort and performance of a skater with outsole shim 10 installed. Height h of plug 52 is equal to thickness t of crown member 20 whereby crown member 20 seats flushly around plug 52. Crown member 20 secures to crest member 50 by perimetrically engaging around central plug 52 in close contact therewith. Inner surface 24 contacts outer surface 56 of central plug 52. Crown member width p is equal to or slightly lesser than the perimetric width q of skirt member 54. Thus crest member 50 seats into crown member 20, with central plug 52 encircled therein.

Figure 2:
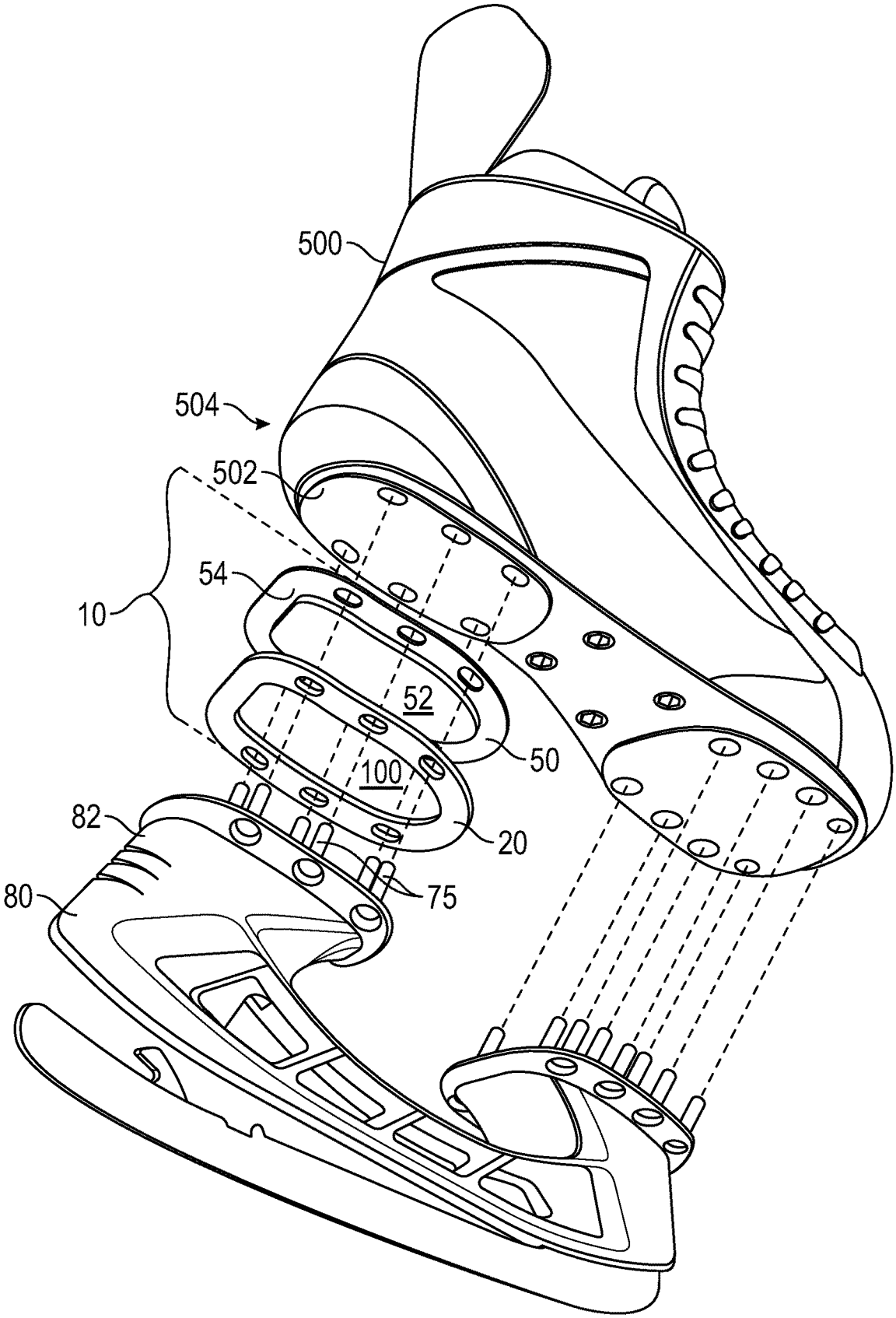
FIG. 2 is an elevation view of an example embodiment of the insertable skate outsole shim for increased attack angle in exploded view in relation to the outsole or a skate boot and the rear post of a skate blade holder.

FIG. 2 illustrates an example embodiment of the outsole shim 10 in exploded view to illustrate the position of the shim 10 when installed upon rear post 82 of blade holder 80. Outsole shim 10 seats atop rear post 82 of blade holder 80 and maps to boot 500 outsole 502 heel 504. Fasteners 75 secure to the outsole 502 by passing through an associated one of plurality of apertures 22. Fasteners 75 may pierce through skirt member 54 to ensure taut engagement therethrough. Once installed, outsole shim 10 serves to raise heel 504 and increase attack angle α by at least height h (some additional height is contemplated by the overlying thickness of the thin skirt member of crest member). See, e.g., FIGS. 3 and 4.

Figure 3:
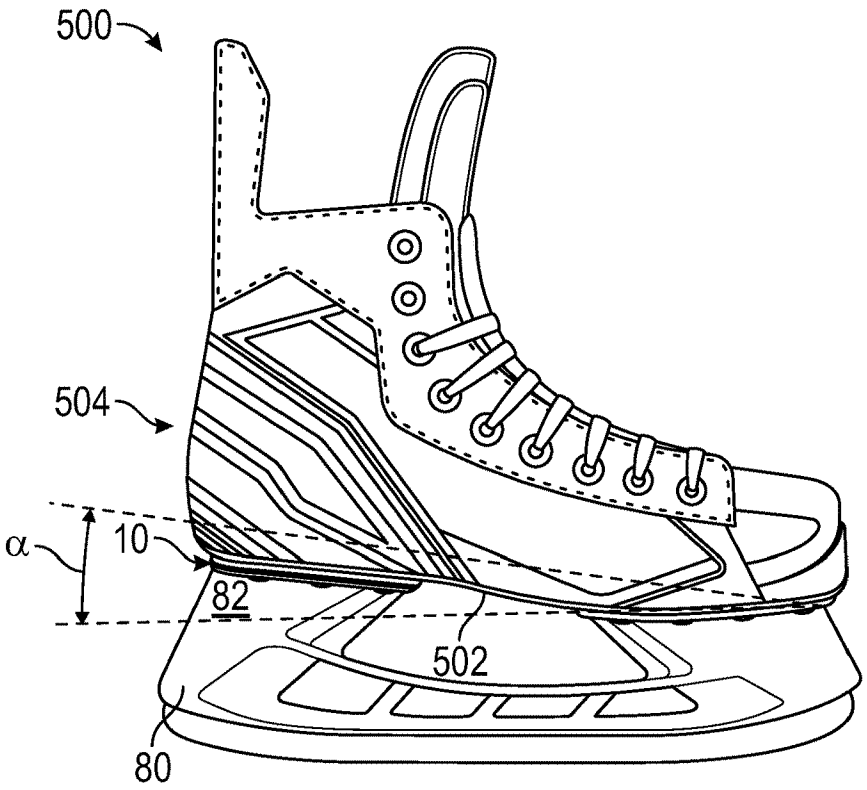
FIG. 3 is a side view of an example embodiment of the insertable skate outsole shim for increased attack angle installed to a skate shown in relation to the same skate without the shim installed to illustrate the increased attack angle engendered by the shim.
Figure 3:
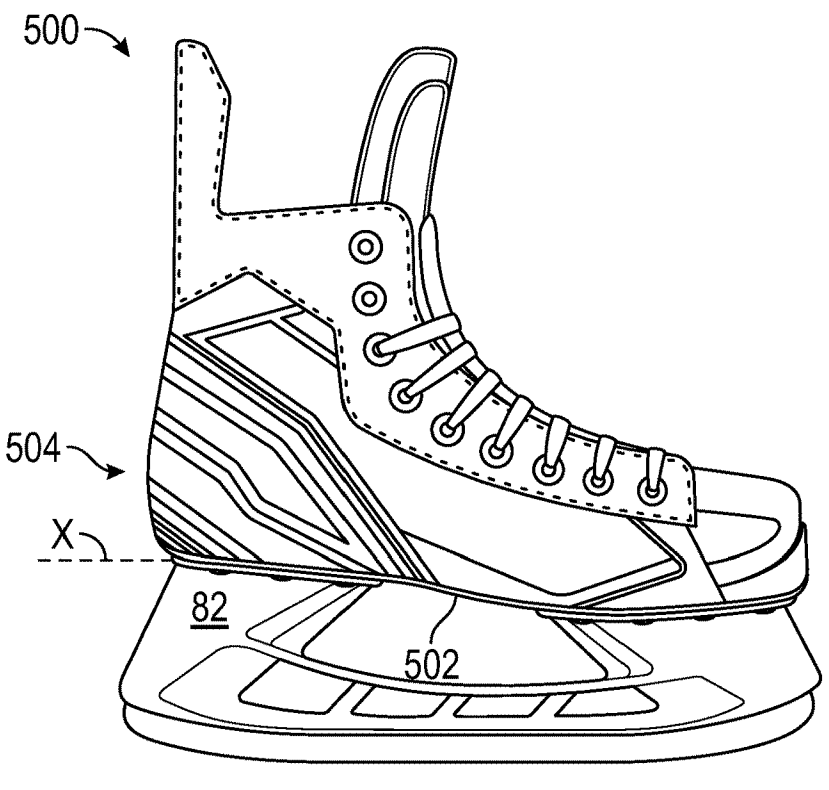

FIG. 3 illustrates an example embodiment of the outsole shim 10 installed to an existing skate 500. Skate 500 is shown with (right) and without (left) outsole shim 10 installed. Outsole shim 10 raises heel 504 by at least height h and increases attack angle α an equivalent amount. Wearing the skate 500 with outsole shim 10 installed therefore orients the skater with heel raised and weight postured forward, for more aggressive skating. Additionally, the outsole shim 10 dampens vibrations, provides an amount of give, and assists absorption of forces exerted thereon during skating; it may therefore increase the longevity of the blade holder 80 or prevent abrupt breakage of the rear post 82, for example.

Figure 4:
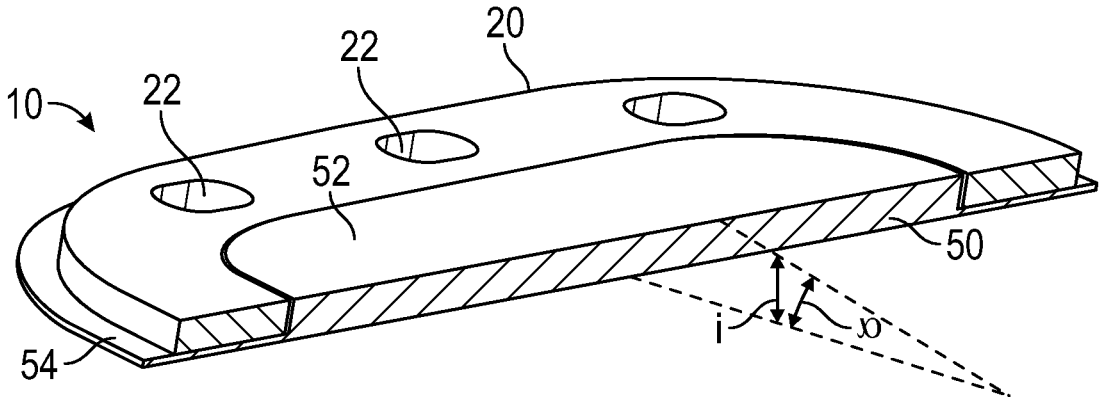
FIG. 4 is a longitudinal cross section view of the example embodiment of the insertable skate outsole shim for increased attack angle shown in FIG. 1 illustrating the flush nesting of a central plug of the crest member into the open center of the crown member.

FIG. 4 illustrates a longitudinal section of the example embodiment of outsole shim 10 depicted in FIGS. 1-4, taken along medial longitudinal axis y. The flush seating of central plug 52 into open center 100 of a crown member 20 is evincible. Height i represents the height by which attack angle α is increased when the outsole shim 10 is installed. It should be readily comprehended by persons of ordinary skill in the relevant art that variances are producible between the relevant parts such that variation in heights t, h, and i may be expressed between and across various embodiments, adapted to produce particular attack angles α for various sized skates 500 and producible to match preference of individual skaters. Thus ranges of sized shims 10 and even individualized shims 10 are contemplated as producible herein.

Figure 5:
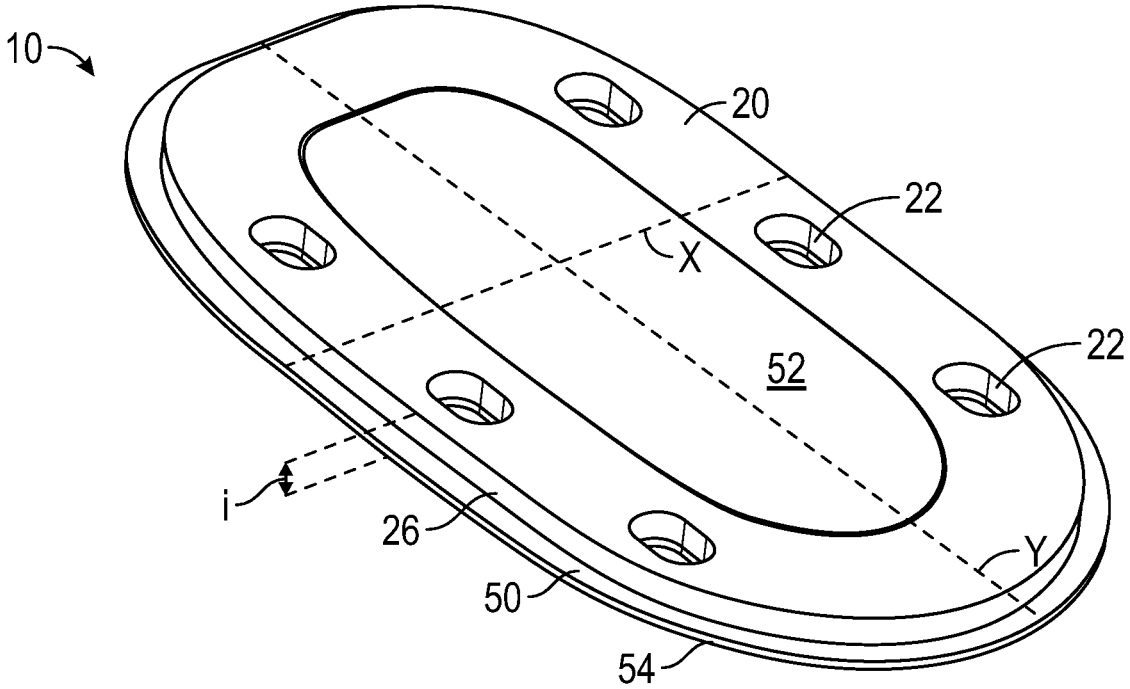
FIG. 5 is an elevation view of an example embodiment of the outsole shim with crown member and crest member assembled together.

FIG. 5 shows the example embodiment of outsole shim 10 depicted in FIGS. 1-4 assembled and in elevation view. In this example embodiment depicted, skirt member 54 extends beyond outer surface 26 of crown member 20. Ellipsoidal apertures 22 in crown member 20 are positioned to accommodate sinking of extant fasteners 75 into outsole 502 of boot 500. The ellipsoidal shape as shown in this example embodiment may enable an amount of play in fitting the shim 10 in a particular position adapted to a particular boot, to map the shim 10 to the correct or desired position atop the rear post 82 and under the boot 500 heel 504. Note that skirt member 54 is thin and flexible, though durably rendered, and may be trimmed down if desired to fit the shim seamlessly into the boot 500 profile.

Figure 6:
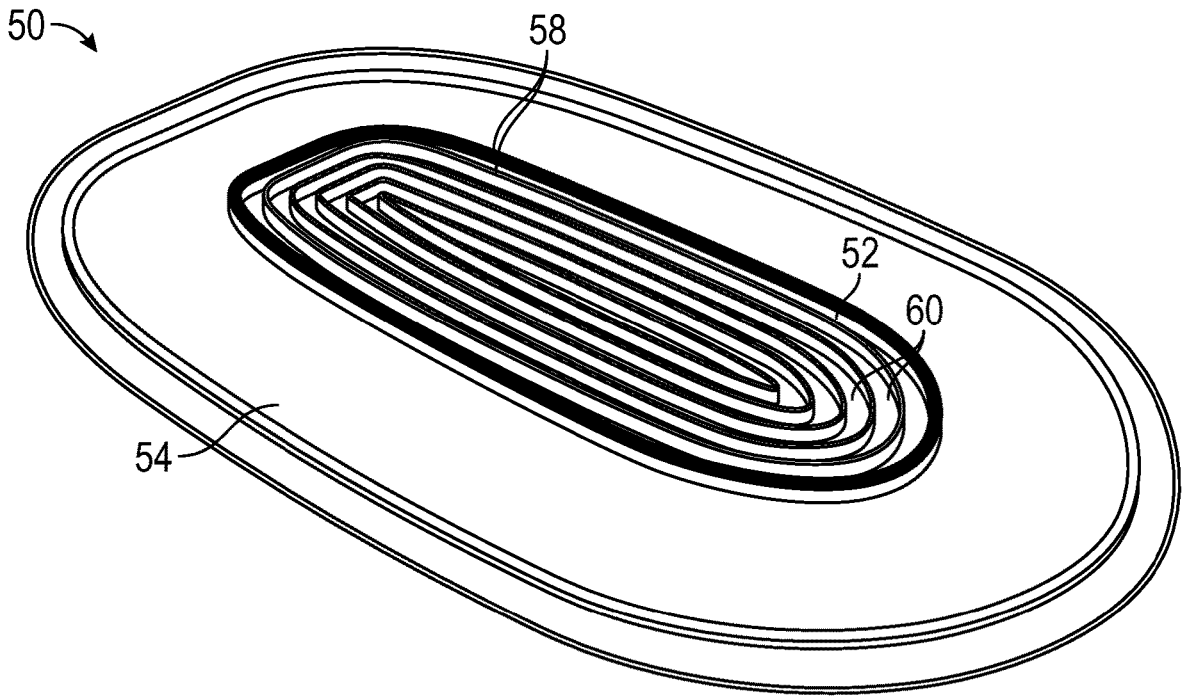
FIG. 6 is a transverse section view of an example embodiment of the rest member with the outermost layer of the central plug removed to show a plurality of concentric rings interior to the plug.

FIG. 6 illustrates an example embodiment of the crest member 50, with the outermost layer of the central plug 52 removed to show a plurality of concentric rings or bands 58 disposed therein. Each of the plurality of concentric rings or bands 58 comprises a vertically oriented rubberlike protrusion disposed encircling a void 60. The central plug 52 is enclosed and the arrangement of the concentric rings or bands 58 bounding voids 60 therein enables compressibility of the plug member 52 which may be varied by the relative size, thickness, and ratio of rings to voids, as case may be, whereby a single means of production (such as molding or additive printing, for example) may yield a range of properties for damping vibrations and absorbing forces applied when skating.

What is claimed is:

1. An insertable skate outsole shim for increased attack angle installable to an existing ice skate comprising:

an outsole shim having a longitudinal axis, a transverse axis, and a vertical axis sized and shaped to seat substantially flush to the boot profile beneath a heel of the ice skate boot and atop at least a rear post of the ice skate blade holder, said outsole shim comprising:

a polymeric, generally rigid crown member molded perimetrically surrounding an open center;

a generally elastomeric polymeric crest member, said crest member comprising:

a central plug disposed to seat flush into the open center of the crown member; and a skirt member disposed to overlie the crown member;

wherein the crest member nests into the crown member such that the crown member presents a relatively rigid perimeter surrounding a relatively compressible, elastomeric center, installable underlying the heel of the skate boot and wherein the thickness of the shim along the vertical axis is associated with a corresponding angle of attack.

2. The insertable skate outsole shim for increased attack angle of claim 1 wherein the shim dampens vibrations and absorbs forces applied through the shim during skating.

3. The insertable skate outsole shim for increased attack angle of claim 2 wherein the open center and the central plug are generally ellipsoidal and wherein the crown member is sized and shaped such that the crown member perimetrically bounds the area atop the rear post of the blade holder underneath the heel of the skate boot.

4. The insertable skate outsole shim for increased attack angle of claim 3 wherein the crest member further comprises a series of nested concentric rings molded vertically oriented interior to the central plug.

5. The insertable skate outsole shim for increased attack angle of claim 4 wherein the crown member includes a plurality of apertures disposed therein whereby the crown member is positionable for securement between the rear post of the blade holder and the heel of the boot by engagement with extant fasteners provided with the blade holder and boot.

6. The insertable skate outsole shim for increased attack angle of claim 5 wherein the extant fasteners pierce the skirt of the crest member to tautly engage therethrough when the shim is installed under the boot heel and the blade holder is reattached thereto.

7. The insertable skate outsole shim for increased attack angle of claim 6 wherein each of the plurality of apertures is ellipsoidal whereby some lateral play enables precise positioning of the shim between the boot heel and the rear post.

8. An insertable skate outsole shim for increased attack angle installable to an existing ice skate, said outsole shim comprising:

a generally ellipsoidal shim sized and shaped to seat flush between the heal of an existing ice skate boot and a rear post of the skate's blade holder, said shim having a longitudinal axis, a transverse axis, and a vertical axis, said shim comprising:

a polymeric, generally rigid crown member, said crown member molded perimetrically surrounding an open generally ellipsoidal center, said crown member sized and shaped such that the crown member perimetrically bounds the area atop the rear post of the blade holder underneath the heal of the skate boot;

a generally elastomeric polymeric crest member, said crest member comprising:

a generally ellipsoidal central plug disposed to seat flush into the ellipsoidal center of the crown member; and a flexible skirt member disposed to overlie the crown member;

wherein the crest member nests into the crown member such that the crown member presents a relatively rigid perimeter surrounding a relatively compressible, elastomeric center, installable underlying the heel of the skate boot whereby installation of the shim to the ice skate increases the angle of attack of a skater wearing the boot.

9. The insertable skate outsole shim for increased attack angle of claim 8 wherein the crest member further comprises a series of nested concentric rings molded transversely oriented interior to the central plug.

10. The insertable skate outsole shim for increased attack angle of claim 9 wherein the crown member includes a plurality of apertures disposed therein whereby the crown member is positionable for securement between the rear post of the blade holder and the heel of the boot by engagement with extant fasteners provided with the blade holder and boot.

11. The insertable skate outsole shim for increased attack angle of claim 10 wherein the extant fasteners pierce the skirt of the crest member to tautly engage therethrough when the shim is installed under the boot heel and the blade holder is reattached thereto.

12. The insertable skate outsole shim for increased attack angle of claim 11 wherein the plurality of apertures are ellipsoidal whereby some lateral play enables precise positioning of the shim between the boot heel and the rear post.

* * * * *